US010377560B2

(12) United States Patent
Naber

(10) Patent No.: US 10,377,560 B2
(45) Date of Patent: Aug. 13, 2019

(54) DEVICE FOR PACKING CUT FLOWERS, AND BUCKET AND PLATE FOR USE IN SUCH DEVICE

(71) Applicant: Naber Plastics B.V., Waalwijk (NL)

(72) Inventor: Steffi Anna Elisabeth Naber, Waalwijk (NL)

(73) Assignee: Naber Plastics B.V., Waalwijk (NL)

( * ) Notice: Subject to any disclaimer, the term of this patent is extended or adjusted under 35 U.S.C. 154(b) by 52 days.

(21) Appl. No.: 15/313,600

(22) PCT Filed: May 27, 2014

(86) PCT No.: PCT/NL2014/050339

§ 371 (c)(1),
(2) Date: Nov. 23, 2016

(87) PCT Pub. No.: WO2015/183073

PCT Pub. Date: Dec. 3, 2015

(65) Prior Publication Data

US 2017/0158418 A1 Jun. 8, 2017

(51) Int. Cl.

| | |
|---|---|
| ***B65D 21/02*** | (2006.01) |
| ***B65D 85/50*** | (2006.01) |
| ***A47F 7/00*** | (2006.01) |

(52) U.S. Cl.

CPC ..... *B65D 85/505* (2013.01); *A47F 7/0078* (2013.01); *B65D 21/0223* (2013.01); *B65D 21/0233* (2013.01)

(58) Field of Classification Search

CPC .... B65D 85/505; B65D 21/0233; B65D 1/46; B65D 21/0223; A47F 7/0078

(Continued)

(56) References Cited

U.S. PATENT DOCUMENTS 2,207,210 A * 7/1940 Von Knauf ..... B65D 43/0216 220/698

3,680,735 A 8/1972 Lucas (Continued)

FOREIGN PATENT DOCUMENTS

JP H08-133370 A 5/1996
NL 8901973 A 2/1991

(Continued)

OTHER PUBLICATIONS

Google translation of NL 8901973 A https://patents.google.com/patent/NL8901973A/nl?oq=NL8901973A.*

(Continued)

*Primary Examiner* — Mollie Impink

(74) *Attorney, Agent, or Firm* — Troutman Sanders LLP; Ryan A. Schneider

(57) ABSTRACT

A device for packing cut flowers incorporating a bucket for use as a bottom part, and further incorporating a sleeve-shaped top part. The bucket incorporates a peripheral channel that is open at a top side for receiving and retaining a bottom portion of the top part, wherein the peripheral channel projects outwardly with respect to a standing wall of the bucket, and wherein the bucket incorporates a filler piece arranged underneath the peripheral channel and connecting up to both a bottom of the peripheral channel and a portion of the standing wall as present underneath the peripheral channel. Due to the presence of the filler piece on the bucket, channels of adjacent buckets being part of stacks containing buckets positioned alongside each other are prevented from meshing together.

15 Claims, 4 Drawing Sheets

(58) Field of Classification Search
USPC ..... 206/516, 423, 515, 519
See application file for complete search history.

(56) References Cited

U.S. PATENT DOCUMENTS

| | | | | |
|---|---|---|---|---|
| 4,848,580 | A | 7/1989 | Wise | |
| 5,060,799 | A * | 10/1991 | De Pagter | B65D 85/505 206/423 |
| 5,323,925 | A | 6/1994 | Apps | |
| 6,474,017 | B1 * | 11/2002 | White | B65D 25/108 47/41.01 |
| 6,581,330 | B1 | 6/2003 | Helsloot et al. | |
| 6,752,270 | B1 * | 6/2004 | Helsloot | B65D 85/505 206/423 |
| 2013/0327736 | A1 | 12/2013 | Del Olmo et al. | |
| 2015/0367988 | A1 * | 12/2015 | Stanek | B65D 21/0224 29/428 |
| 2017/0043941 | A1 * | 2/2017 | van den Heijkant | B65D 85/505 |

FOREIGN PATENT DOCUMENTS

| | | | |
|---|---|---|---|
| NL | 1009100 | C | 11/1999 |
| WO | 2015/122774 | A1 | 8/2015 |

OTHER PUBLICATIONS

International Search Report in related International Patent Application No. PCT/NL2014/050339, dated May 7, 2015.
Search Report in related NL Patent Application No. 2014852, dated Oct. 30, 2015.
Search Report in related NL Patent Application No. 2016336, dated Sep. 23, 2016.

* cited by examiner

Fig. 3
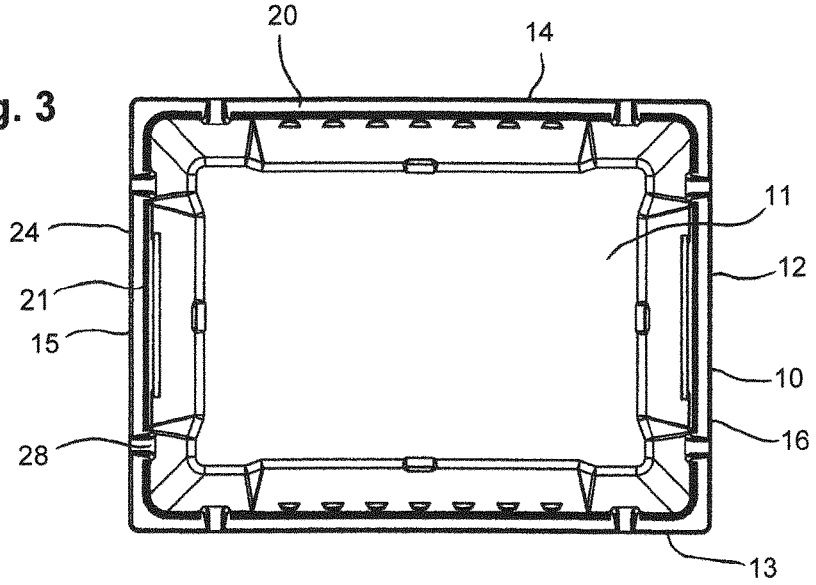
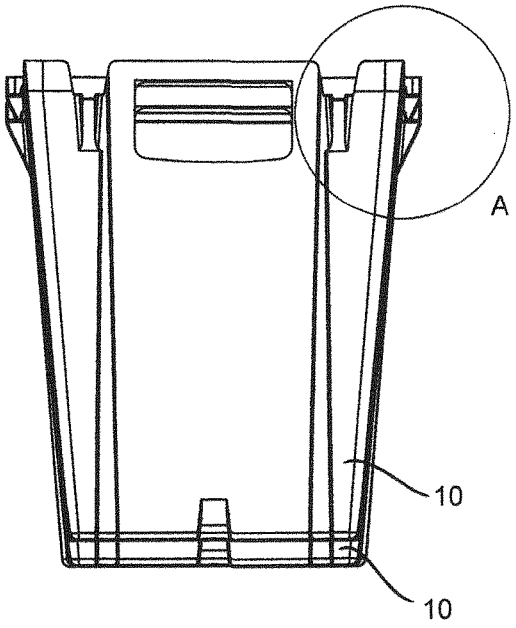
Fig. 4
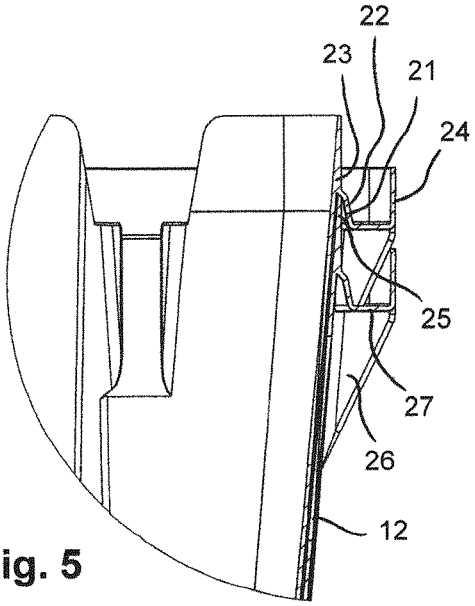
Fig. 5

DEVICE FOR PACKING CUT FLOWERS, AND BUCKET AND PLATE FOR USE IN SUCH DEVICE

CROSS-REFERENCE TO RELATED APPLICATIONS

This application is a US National Stage of International Patent Application No. PCT/NL2014/050339, filed 27 May 2014, the contents of which are fully incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The invention relates to a bucket for use as a bottom part of a device for packing cut flowers which furthermore comprises a sleeve-shaped top part, wherein the bucket comprises a peripheral channel which is open at a top side for receiving and retaining a bottom portion of the top part of the device, and wherein the peripheral channel projects outwardly with respect to a standing wall of the bucket. The invention also relates to a plate for use with a bucket as mentioned. Further, the invention relates to a device for packing cut flowers, comprising a bottom part constituted by a bucket as mentioned, and a sleeve-shaped top part. Still further, the invention relates to a stack of devices for packing cut flowers.

2. Description of Related Art

A device for packing cut flowers is known in the art. For example, U.S. Pat. No. 6,581,330 discloses a packaging for cut flowers comprising: a rectangular bucket with sloping side walls which are provided close to their top walls with a channel that projects outwards and is open at the top, the base of which channel serves to support a foldable rectangular protective tube. The purpose of the rectangular tube is to protect those parts of cut flowers placed in the bucket which extend above the bucket during transport and during presentation at auction or when put up for sale at wholesale markets. When the packaging is in a final position where the flowers are to be displayed, the rectangular tube is removed, the flowers fanning out in the bucket without having to be transferred.

Among other things, the known packaging may comprise a rectangular presentation collar which is suitable to be used in case the cut flowers have a relatively large length. The presentation collar is shorter than the protective tube as mentioned in the foregoing, so that when the protective tube has been removed, the top part of the flower stems with flowers extends well above the top edge of the presentation collar. The packaging comprises a shoulder which extends between the top edge of the sloping side walls of the bucket and the base or the bottom end of an inner flange of the channel, and which has a function of supporting the presentation collar besides other functions.

After having been removed from the top of the bucket, the protective tube can be utilized to support the bucket. To this end, the under surface of the base of the channel can form the base surface of another channel, particularly a channel which is open at the bottom, which is intended to form a seating channel for the top edge of the protective tube if the bucket is inserted from above into the protective tube.

A number of disadvantages is associated with the packaging known from U.S. Pat. No. 6,581,330. One of these disadvantages relates to the presence of the channel of the bucket that projects outwards and is open at the top. In practice, it appears that when a number of stacks containing buckets are positioned adjacent to each other, e.g. for transport purposes, there is a risk that a top side of an outer flange of the channel of a bucket in one stack ends up underneath the base of the channel of a bucket in an adjacent stack, as a result of which the latter bucket is lifted to some extent at the side where the channels mesh together, which causes the latter bucket and the stack of which the bucket is part to tilt away from the other stack. Hence, there is a risk that a stack containing buckets tilts and falls down, e.g. when a number of stacks containing buckets as present on a pallet are lifted by a fork-lift truck, which is highly undesirable. For the sake of completeness, it is noted that a stack containing buckets can be a stack of devices for packing cut flowers, wherein a bucket is part of each of the devices, or a stack of buckets only.

The problem of the channels of buckets of adjacent stacks meshing together in the way as described in the foregoing is associated with a relatively small height of the channel. Due to this relatively small height, only little mutual movement of the buckets suffices for obtaining the effect of the top side of the outer flange of the channel of one bucket ending up underneath the base of the channel of the other bucket. Hence, an obvious solution to the problem may be found in increasing the height of the channel. However, such solution would introduce a new problem, namely a decrease of the extent to which the buckets can be nested into one another, so that less buckets can be stacked before a maximum height of a stack of buckets is reached. Another obvious solution may be found in taking measures that stacks containing buckets are not positioned too closely together. However, such solution would also introduce a new problem, namely a decrease of the number of stacks that can be transported by means of one supporting device such as a pallet. Furthermore, amending the design of the bucket such that the channel projects inwardly with respect to the standing wall does not constitute a feasible option as doing so would result in an irregularity at the inside of the bucket which might be harmful to the cut flowers to be contained by the bucket.

BRIEF SUMMARY OF THE INVENTION

It is an objective of the invention to provide another solution to the problem of the channels of buckets of adjacent stacks meshing together in the way as described in the foregoing, which does not involve a decrease of the number of buckets that can be transported in a certain volume. According to the invention, the problem is solved by providing a bucket which comprises at least one filler piece arranged underneath the peripheral channel and connecting up to both a bottom of the peripheral channel and a portion of the standing wall as present underneath the peripheral channel.

By using at least one filler piece as mentioned, it is achieved that at the position of such filler piece, it is not possible for the top side of an outer standing wall of the channel of one bucket to end up underneath a bottom of the channel of another bucket, because the filler piece is in the way. Hence, by having one or more filler pieces at appropriate positions along the periphery of the bucket, it is possible to remove the risk of tilting of a stack containing buckets as a result of meshing effects of the channels of buckets of adjacent stacks. For example, in case the bucket has a rectangular periphery at the position where the channel is present, a pair of filler pieces may be present at each side of the rectangular shape, wherein it is advantageous if each of the filler pieces is positioned near to the respective corner of the bucket.

In the framework of the invention, the filler piece can have any suitable size and shape, as long as the filler piece is capable of preventing the channel of one bucket from meshing with the channel of another bucket, at a side of that other bucket facing the one bucket, and thereby causing that other bucket to tilt. It may be sufficient to use a minimum of material for realizing the filler piece, especially if one filler piece of limited size is capable of preventing channels of adjacent buckets from meshing together along a certain length of the channels, which is the case if the bucket has a rectangular periphery at the position of the channel. For example, the filler piece may have a narrow, sheet-like appearance. In order to let the filler piece constitute a smooth transition between the standing wall of the bucket and the bottom of the peripheral channel, it is advantageous for the filler piece to be beveled, wherein a width of the filler piece increases in upward direction. With such an appearance of the filler piece, it is ensured that the channel of an adjacent bucket can only slide along the filler piece of the bucket concerned and cannot get stuck underneath the channel of that bucket. Preferably, on the basis of the presence of the filler piece, not a portion of the bottom of the peripheral channel is left which may be engaged by a top side of the outer standing wall of the peripheral channel of an adjacent bucket. Hence, it is preferred if a width of the filler piece corresponds to a width of the bottom of the peripheral channel at a position where the filler piece is connected to the bottom of the channel.

In a preferred design of the bucket according to the invention, at least a bottom portion of an inner standing wall of the peripheral channel extends at a distance with respect to the standing wall of the bucket. In such a case, a space is present between said at least a bottom portion of the inner standing wall of the peripheral channel and the standing wall of the bucket. When a first bucket is stacked on top of a second bucket, it is possible for a top portion of the standing wall of the second bucket to be received in that space as present at the level of the channel of the first bucket, whereby it is achieved that the first bucket can be nested deeper into the second bucket than in case the design of the bucket would not include a space as mentioned and the top portion of the standing wall of the second bucket could not be made to extend beyond the level of the bottom of the peripheral channel of the first bucket. Also, it is achieved that the first bucket is supported by the second bucket in a defined manner, namely on the basis of contact to the top portion of the standing wall of the second bucket.

It is practical for the peripheral channel to be continuous along the periphery of the bucket, however, this is not essential in the framework of the invention. In any case, it is possible that at least one opening is arranged in an inner standing wall of the channel, constituting a passage between the channel and an internal space of the bucket as defined by a bottom and the standing wall of the bucket. A first advantage of the presence of such opening is that in case the bucket is combined with a sleeve-shaped top part for the purpose of packing cut flowers, and water flows down along the top part, the water is made to flow to the internal space of the bucket. This is especially advantageous in case several assemblies of bucket and sleeve-shaped top part constituting packages for cut flowers are positioned on top of each other. If, in a package not being a bottom package of a stack of packages, water flowing down along the sleeve-shaped top part would not be supplied to the bucket supporting the top part by means of the channel, it would be possible for the water to continue along a path at the outside and to reach the flowers which are packed in an underlying package, as a result of which those flowers may turn brown. Hence, on the basis of the presence of at least one opening in an inner standing wall of the peripheral channel of the bucket, preservation of quality of the flowers can be guaranteed. A second advantage of the presence of such opening is that it provides for open space at a position which may be chosen such as to correspond to a position of a filler piece. This is the case when the opening is positioned in a portion of the channel which is present above a filler piece. When the buckets are stacked, and the buckets are designed such that there are open spaces in the inner standing wall of the channels of the buckets at positions corresponding to the positions of the filler pieces, the filler pieces of buckets at higher levels in the stack can be partially received in the channels of the underlying buckets, as a result of which the buckets can be nested into one another along an optimal depth, wherein there is no hindrance by the filler pieces.

For the sake of completeness, it is noted that there is actually a risk that the components of a package for cut flowers get wet at an outside thereof, so that a situation like the situation as described in the foregoing, in which water flows down the top part, really occurs in practice. This is especially the case when packages are displaced from a relatively cold place to a relatively warm place, wherein condensation may occur.

The invention also relates to a plate for use with the bucket as described in the foregoing, adapted to receive and retain a bottom portion of the bucket. In this respect, it is noted that the packaging known from U.S. Pat. No. 6,581,330 comprises a plate which fits on the protective tube. On its top surface, the plate is provided with ribs, on which a bucket stacked on top can bear in such a way that a ventilation gap is produced between the top surface of the plate and the bottom surface of a bucket stacked on top. Said ventilation gap is beneficial for the quality of the flowers packed in the underlying bucket. Positioning ridges for lateral positioning of a bucket stacked on the plate are preferably arranged on the top surface of the plate, which ridges project above the ribs and are nestable in the case of plates stacked on top of one another. As a result of the nestable ridges, plates stacked on top of one another take up little height when being returned to the sender.

An advantageous feature of the plate according to the invention is the presence of a channel in the plate which is open at a top side for enabling the plate to receive liquid from the outside of a bucket stacked on top. In a stack of packages comprising combinations of a bucket, a sleeve-shaped top part and a plate, and being filled with cut flowers, the application of a channel in the plate provides a possibility for preventing liquid such as condensed water from dripping on the flowers as present in an underlying bucket. As has been mentioned in the foregoing, the quality of the flowers can be preserved when there is no risk of liquid falling on the flowers.

In a practical embodiment of the plate according to the invention, the channel extends at a position which is inward and at a distance from an outer periphery of the plate. Such embodiment of the plate is especially suitable to be used with buckets having a generally tapering shape along their height, having larger peripheral dimensions at their top than at their bottom. In general, such type of buckets is preferred due to the fact that the buckets can be nested into one another very well.

In case the plate is adapted for use with a bucket of which at least a bottom portion has a rectangular outer periphery, it is practical for the outer periphery of the plate to be rectangular as well, wherein the plate, like the plate known from U.S. Pat. No. 6,581,330, may comprise standing elements having a top recess for receiving a corner portion of the bottom portion of a bucket, and wherein the standing elements may be hollow at a bottom side.

Further, the invention relates to a device for packing cut flowers, comprising a bottom part constituted by a bucket as described in the foregoing, and a sleeve-shaped top part, wherein the top part is received and retained in the peripheral channel of the bucket. Such device may contain cut flowers and further comprise a plate as described in the foregoing, wherein the plate is placed on top of the top part.

Still further, the invention relates to a stack of devices comprising the assembly of the bucket and the sleeve-shaped top part as mentioned, and also containing cut flowers and further comprising the plate as mentioned, wherein the bucket of any device in the stack above a device located at a bottom of the stack is positioned on top of the plate of an underlying device in the stack. In general, the plate is suitable to be used both for bearing at a sleeve-shaped top part at the bottom side thereof and supporting a bucket at the top side thereof.

BRIEF DESCRIPTION OF THE SEVERAL VIEWS OF THE DRAWINGS

The present invention will be further explained on the basis of the following description of device for packing cut flowers, especially a bucket and a plate which are part of the device, with reference to the drawing, in which equal reference signs indicate equal or similar components, and in which:

FIG. 3 shows a top view of the bucket;

FIG. 4 shows a front view of two buckets which are nested into one another;

FIG. 5 shows a sectional view of detail A of FIG. 4;

DETAILED DESCRIPTION OF THE INVENTION

It is noted that the use of terms such as "bottom" and "top" is related to a normal orientation of the device for packing cut flowers and the various components thereof, i.e. an orientation in which a bottom of the bucket is at a bottom side, in which the sleeve has a generally vertical orientation, being open at both a top side and a bottom side, and in which the plate is capable of receiving and retaining a bucket at a top side thereof and a top portion of the sleeve at a bottom part thereof.

Figure 1:
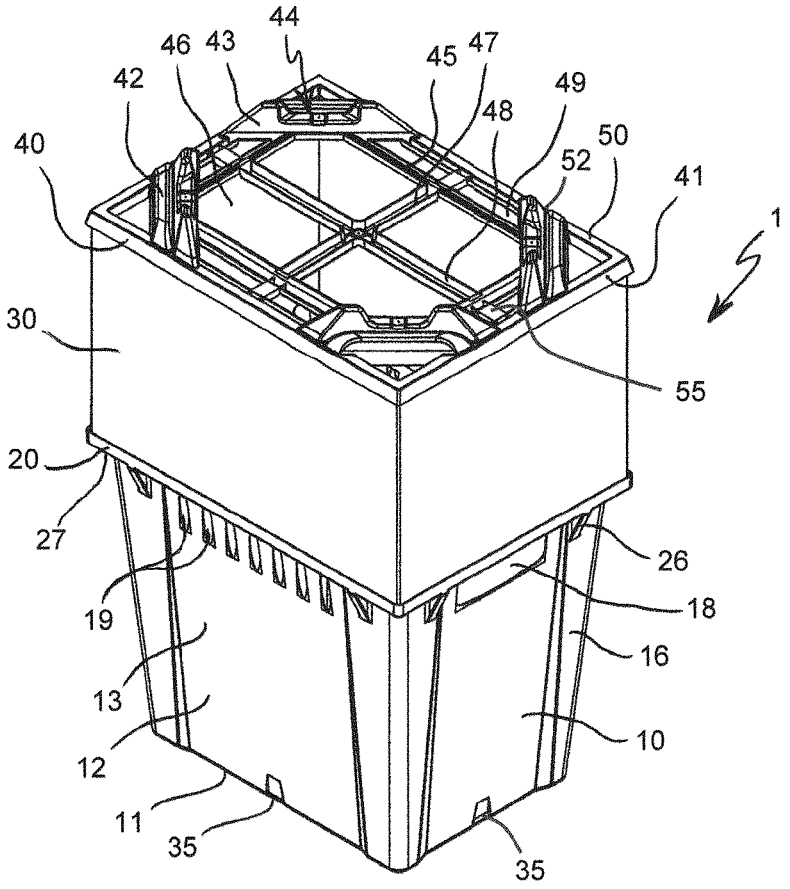
FIG. 1 shows a front view of the device according to the invention, comprising a bucket at a bottom side thereof, a plate at a top side thereof, and a sleeve extending between the bucket and the plate, wherein a bottom portion of the sleeve is held in a peripheral channel of the bucket.

FIG. 1 shows a device 1 according to the invention, which is intended to be used for packing cut flowers. In general, the device 1 comprises a bucket 10 for containing the cut flowers and furthermore containing a quantity of liquid, a sleeve 30 for protecting parts of the cut flowers which extend above the bucket 10, and a plate 40 for enabling another bucket 10 to be placed on top of the device 1 and preventing such bucket 10 from shifting in a sideward direction with respect to the underlying bucket 10. In a practical embodiment of the invention, both the bucket 10 and the plate 40 are manufactured from plastic, whereas the sleeve 30 may be manufactured from cardboard, to mention one example of many possibilities. At a bottom side, the bucket 10 is provided with recesses 35 which have a function in keeping a strap (not shown) in place, which strap can be arranged around an assembly of the bucket 10, the sleeve 30 and the plate 40 for keeping these components of the device 1 according to the invention together.

The device 1 according to the invention is especially suitable to be used for the purpose of transporting cut flowers. By applying the device 1, safe transport of the cut flowers is guaranteed, as the flowers are protected by the device 1. Also, on the basis of the capability of the bucket 10 to contain a quantity of liquid, the cut flowers can be kept in a proper condition, wherein the flowers are prevented from drying. In most practical cases, transport of a plurality of devices 1 according to the invention, wherein each device 1 contains cut flowers, will be required. In such cases, stacks are made, wherein each stack comprises a number of buckets 10 positioned on top of each other, and these stacks are positioned alongside each other, e.g. on a pallet.

In a practical embodiment of the device 1 according to the invention, the bucket 10, the sleeve 30 and the plate 40 have a generally rectangular periphery, as is the case in the shown example. That does not alter the fact that in the framework of the invention, it is possible to have another periphery. In any case, it is most practical for the peripheries of the bucket 10, the sleeve 30 and the plate 40 to be adapted to each other.

Figure 2:
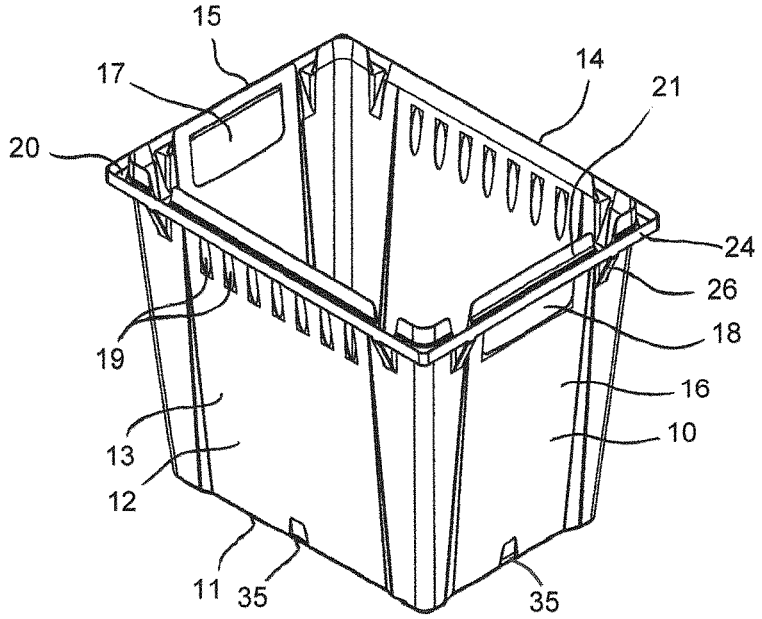
FIG. 2 shows a perspective view of the bucket.

With reference to FIGS. 2 and 3, further details of the bucket 10 will now be described. In general, like any common bucket, the bucket 10 comprises a bottom 11 and a standing wall 12. In the shown example, the standing wall 12 has a rectangular periphery and comprises a front wall part 13, a back wall part 14, a left wall part 15 and a right wall part 16. In order to facilitate handling of the bucket 10, apertures 17, 18 are arranged in the left wall part 15 and the right wall part 16, so that a user can easily take hold of the bucket 10 as the apertures 17, 18 leave space for allowing a user to insert the fingers of both hands through the left wall part 15 and the right wall part 16 from outside of the bucket 10. The front wall part 13 and the back wall part 14 are provided with a plurality of holes 19 in order to allow for ventilation of the cut flowers to be contained by the bucket 10. The bucket 10 has a generally tapering shape along its height, wherein a bottom periphery of the bucket 10 is smaller than a top periphery of the bucket 10, so that it is very well possible for at least two buckets 10 to be nested into one another to an optimum extent, so that the height of a stack of buckets 10 is kept to a minimum. In this respect, it is noted that two buckets 10 which are nested into one another are shown in FIG. 4.

For the purpose of supporting the sleeve 30, the bucket 10 comprises a peripheral channel 20 which projects outwardly with respect to the standing wall 12 of the bucket 10 and which is open at the top for receiving a bottom portion of the sleeve 30. The peripheral channel 20, which will hereinafter be referred to as sleeve receiving channel 20, is located at the top side of the bucket 10. In general, the shape and the dimensions of the sleeve receiving channel 20 are adapted to the shape and the dimensions of the sleeve 30 in such a way that the sleeve 30 can readily be put in place in the channel 20 by a user. In the shown example, an inner standing wall 21 of the sleeve receiving channel 20 comprises a bottom portion 22 extending at a distance from the standing wall 12 of the bucket 10 and a top portion 23 constituted by a part of the standing wall 12, whereas an outer standing wall 24 of the channel 20 extends at a distance from both portions 22, 23 of the inner standing wall 21, as can be seen in FIG. 5. For example, dimensions of the periphery of the bucket 10 can be about 30×40 cm at the top side thereof, and a width of the sleeve receiving channel 20 can be about 1 cm or somewhat smaller like about 0.9 cm or about 0.8 cm, whereas it is practical for a height of the sleeve receiving channel 20 to be in the same order of magnitude as the width thereof, which does not alter the fact that other dimensional ratios are possible in the framework of the invention.

An advantage of having a bottom portion 22 of the inner standing wall 21 of the sleeve receiving channel 20 at a position which is at a distance from the standing wall 12 of the bucket 10 is that a space is realized which is accessible from the bottom side. When one bucket 10 is stacked on top of another bucket 10, the extent to which the top bucket 10 can be nested into the bottom bucket 10 is enhanced as a top portion 25 of the standing wall 12 of the bottom bucket 10 can be received in the space. Furthermore, it is achieved that the top bucket 10 is supported by the bottom bucket 10 on the basis of contact to the top portion 25 of the standing wall 12 of the bottom bucket 10, on the basis of which a reliable nature of the support is guaranteed and there is no risk that the top bucket 10 gets stuck inside the bottom bucket 10.

A top edge of the apertures 17, 18 as arranged in the left wall part 15 and the right wall part 16 of the standing wall 12 of the bucket 10 is at the position of the transition from the bottom portion 22 of the inner standing wall 21 of the sleeve receiving channel 20 to the top portion 23 of the inner standing wall 21 of the channel 20, so that a gripping edge which is as comfortable as possible for a user is obtained in the apertures 17, 18.

The bucket 10 is equipped with a number of filler pieces 26 which are arranged underneath the sleeve receiving channel 20, connecting up to both a bottom 27 of the channel 20 and a portion of the standing wall 12 of the bucket 10 as present underneath the channel 20. In the shown example, each filler piece 26 has a narrow, sheet-like appearance, wherein filler piece 26 has a generally perpendicular orientation with respect to the wall part 13, 14, 15, 16 at which it is present. Preferably, the filler pieces 26 are beveled as is the case in the shown example, wherein it is practical for the filler pieces 26 to be as wide as the sleeve receiving channel 20 at a top side and to have a decreasing width in a downward direction. In the shown example, two filler pieces 26 are arranged at each wall part 13, 14, 15, 16 of the standing wall 12 of the bucket 10, at positions near the corners of the bucket 10. By having the filler pieces 26 as mentioned, it is achieved that when the bucket 10 is positioned alongside another bucket 10, at a close distance, there is a no risk of the sleeve receiving channels 20 of the buckets 10 meshing together, which might otherwise result in a tilted orientation of the bucket 10 of which the channel 20 is lifted to some extent at the side where the meshing effect takes place. Such result is particularly undesirable when the bucket 10 is part of a stack containing buckets 10 which might fall to the side even when one bucket 10 is tilted to only a small extent.

In order to not let the presence of the filler pieces 26 underneath the sleeve receiving channel 20 influence the extent to which buckets 10 can be nested into one another, it is advantageous to have openings 28 in the inner standing wall 21 of the channel 20, at positions corresponding to the positions of the filler pieces 26. When one bucket 10 is placed on top of another bucket 10, the openings 28 in the inner standing wall 21 of the channel 20 of the bottom bucket 10 constitute spaces where the filler pieces 26 of the top bucket 10 can be located, so that the filler pieces 26 do not abut with the inner standing wall 21 of the channel 20 of the bottom bucket 10, which would otherwise cause the top bucket 10 to be supported on the bottom bucket 10 through the filler pieces 26 so that the top bucket 10 would be at a higher position. In general, the bucket 10 is free from obstacles at the outside which might decrease the extent to which buckets 10 can be nested into one another. A further advantage of the presence of the openings 28 in the inner standing wall 21 of the channel 20 is that the openings 28 enable discharge of water from the channel 20 to the internal space of the bucket 10.

Figure 6:
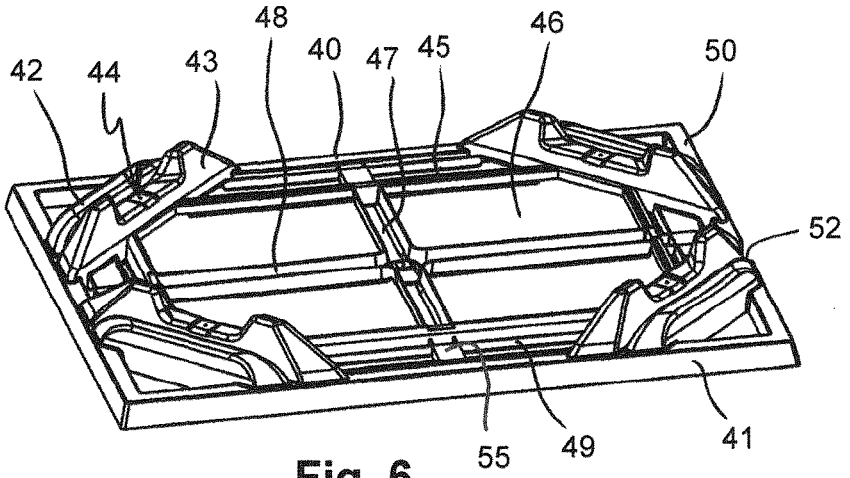
FIG. 6 shows a perspective view of the plate.
Figure 7:
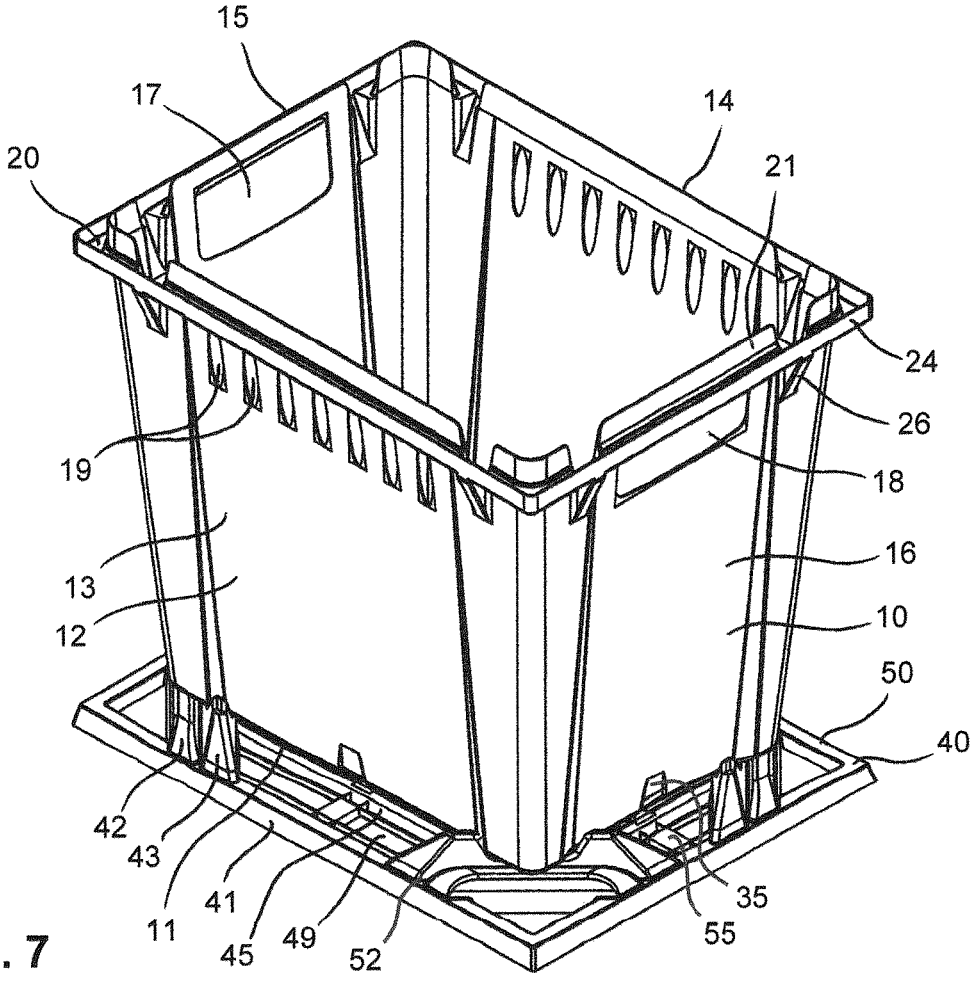
FIG. 7 shows a perspective view of the plate and the bucket, wherein the bucket is positioned on top of the plate.

With reference to FIG. 6, further details of the plate 40 will now be described. The plate 40 is both suitable to be placed on top of a sleeve 30 and to be used as a support of a bucket 10. In particular, the plate 40 comprises an outer standing wall 41 extending in a generally downward direction, which is suitable for closely surrounding a top portion of the sleeve 30. In the shown example, the plate 40 has a rectangular periphery and is equipped with elements 42, 43 positioned at the corners of the plate 40 for supporting the bucket 10 and retaining the corners of the bucket 10. The elements 43 for retaining the corners of the bucket 10 are standing elements having a top recess 44. When the bucket 10 is in place on the plate 40, in a way as shown in FIG. 7, the bucket 10 is prevented from moving sideward with respect to the plate 40 due to the fact that corner portions of the bucket 10 are accommodated in the top recesses 44 of the elements 43 as mentioned.

The plate 40 is equipped with a channel 45 which is open at the top side and which is positioned such as to be capable of receiving water dripping/flowing down at the outside of the bucket 10. On the basis of the presence of the channel 45, the plate 40 has a function in protecting the water from reaching any underlying cut flowers. In general, the shape and the dimensions of the channel 45 are adapted to the shape and the dimensions of the bottom periphery of the bucket 10. In the embodiment of the plate 40 as shown, the channel 45 extends at a position which is inward and at a distance from an outer periphery of the plate 40 on the basis of the fact that the bottom periphery of the bucket 10 as shown is smaller than the top periphery of the bucket 10 and the periphery of the sleeve 30. Furthermore, in the embodiment of the plate 40 as shown, the channel 45 comprises four portions which are separated from each other by the corner elements 43 for retaining the corners of the bucket 10. Between each set of the two types of corner elements 42, 43, a narrow channel 52 is present which also has a function in receiving water and discharging water in an outward direction, i.e. a direction toward the peripheral rim 50 of the plate 40. Hence, the channel 52 is another measure for ensuring that water is always discharged in an outward direction in order to prevent the water from reaching and spoiling flowers.

The design of the plate 40 is aimed at saving material and having optimal ventilation of the cut flowers. In particular, in a center portion thereof, four relatively large holes 46 are present in the plate 40, defined by two ribs 47, 48 arranged in a cross-like configuration. Also, holes 49 are present between the channel 45 and a peripheral rim 50 of the plate 40 of which the outer standing wall 41 of the plate 40 is part, which holes 49 allow for ventilation of cut flowers as present in an underlying assembly of a bucket 10 and a sleeve 30, even when a bucket 10 is placed on top of the plate 40. The ribs 47, 48 comprise U sections which are open at the top side, and which are closed at the bottom side in order to allow users to take hold of the ribs 47, 48 and wrap their fingers around the ribs 47, 48 at the bottom side thereof in a comfortable manner. Due to the cross configuration of the ribs 47, 48, it is very well possible for a user to pick up the plate 40 with just one hand if so desired, particularly at a central position of the cross configuration as mentioned. Furthermore, at the ends of the ribs 47, 48, guiding elements 55 are provided for guiding a strap (not shown) which can be used for keeping an assembly of a bucket 10, a sleeve 30 and a plate 40 as shown in FIG. 1 together.

Figure 8:
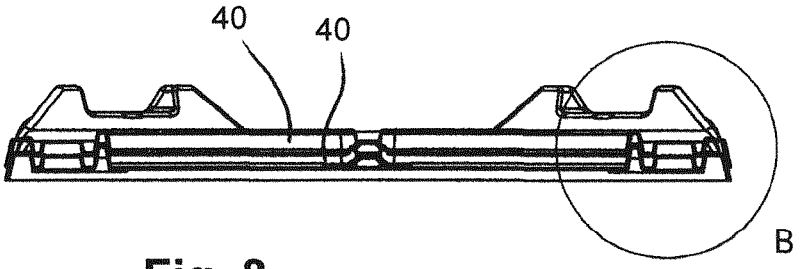
FIG. 8 shows a front view of two plates which are positioned on top of each other.
Figure 9:
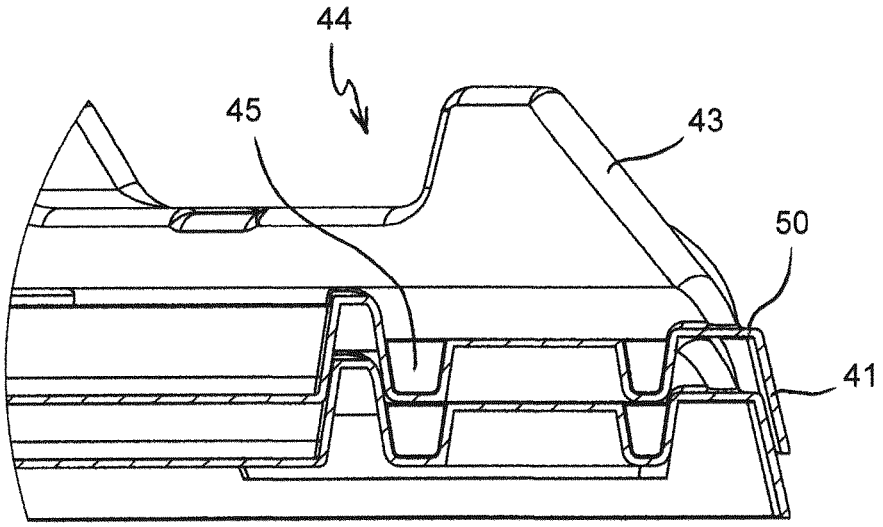
FIG. 9 shows detail B of FIG. 8.

With reference to FIGS. 8 and 9, it is noted that the design of the plate 40 is aimed at having a minimal height of a stack of plates 40. The corner elements 42, 43 of the plate 40 are shaped such as to be hollow at a bottom side, so that the corner elements 42, 43 of successive plates 40 in a stack of plates 40 are nestable into one another. FIGS. 8 and 9 illustrate how close the plates 40 can be together in a stack as a result of such design.

All in all, the device 1 for packing cut flowers comprising the bucket 10, the sleeve 30 and the plate 40 as shown in the figures and described in the foregoing is easy to use, as the device 1 can be easily assembled by placing the sleeve 30 on top of the bucket 10, wherein a bottom portion of the sleeve 30 readily fits into the sleeve receiving channel 20 of the bucket 10, and by placing the plate 40 on top of the sleeve 30, with the outer standing wall 41 of the plate 40 in a position for surrounding the sleeve 30, and can also be easily disassembled. The bucket 10 is suitable for receiving cut flowers, which are furthermore protected once the sleeve 30 has been put in place on the bucket 10. Stacks of the devices 1 can be made in an easy and safe manner, as the components 10, 30, 40 of the devices 1 are designed such as to retain each other in a lateral direction, and the plates 40 are designed such as to interact with a sleeve 30 at one side and with a bucket 10 at the other side. Also, stacks of buckets 10 only can be made, as well as stacks of plates 40 only, wherein the extent to which the buckets 10 can be nested into one another and the extent to which the plates 40 can be nested into each other is optimal, so that a maximum number of buckets 10 and plates 40 can be stacked in a certain space. The sleeve 30 can be made such as to be foldable, so that it is possible to have a flat appearance of the sleeve 30 for transport and storage purposes. The components 10, 30, 40 of the device 1 for packing flowers can be designed such as to be lightweight, wherein the wall thickness of the components 10, 30, 40 and their elements is as small as possible without resulting in a construction which is too weak for being applied in the ways as described in the foregoing.

It will be clear to a person skilled in the art that the scope of the present invention is not limited to the examples discussed in the foregoing, but that several amendments and modifications thereof are possible without deviating from the scope of the invention as defined in the attached claims.

It is noted that the bucket 10 may be provided with a circumferential bottom edge (not shown), i.e. a circumferential edge extending in a downward direction with respect to the bottom 11 of the bucket 10, in order to prevent water flowing down the standing wall 12 of the bucket 10 from rounding the transition between the standing wall 12 and the bottom 11, adhering to the bottom 11 until a central position at the bottom 11 has been reached, and falling down from the bucket 10 at that position. In such a case, if the bucket 10 is positioned in a stack of devices 1 according to the invention and is at a higher level than at least one other bucket 10 containing flowers, the water is prevented from reaching a central position in the stack, so that the risk that the water drips on the flowers of the lower bucket 10 is eliminated.

In the foregoing, a device 1 for packing cut flowers has been described, which comprises a bucket 10 for use as a bottom part, and which further comprises a sleeve-shaped top part 30. The bucket 10 comprises a peripheral channel 20 which is open at a top side for receiving and retaining a bottom portion of the top part 30, wherein the peripheral channel 20 projects outwardly with respect to a standing wall 12 of the bucket 10, and wherein the bucket 10 comprises at least one filler piece 26 arranged underneath the peripheral channel 20 and connecting up to both a bottom 27 of the peripheral channel 20 and a portion of the standing wall 12 as present underneath the peripheral channel 20. Due to the presence of the filler piece 26 on the bucket 10, channels 20 of adjacent buckets 10 being part of stacks containing buckets 10 positioned alongside each other are prevented from meshing together.

The invention claimed is:

1. A bucket for use as a bottom part of a packing device comprising:

a standing wall; and a peripheral channel having a bottom and an inner standing wall;

wherein the peripheral channel is open at a top side for receiving and retaining a bottom portion of a top part of the packing device;

wherein the peripheral channel projects outwardly with respect to the standing wall; and wherein a bottom portion of the inner standing wall of the peripheral channel extends at a distance to the standing wall of the bucket so that at the level of the peripheral channel a space is present between the bottom portion of the inner standing wall of the peripheral channel and the standing wall of the bucket, which space is accessible from the bottom side;

wherein a top portion of the inner standing wall of the peripheral channel is constituted by the standing wall of the bucket; and wherein the space present between the bottom portion of the inner standing wall of the peripheral channel and the standing wall of the bucket functions to receive and accommodate a top portion of the standing wall of a second bucket when the bucket is stacked as the first bucket on top of the second bucket so that the top portion of the standing wall of the second bucket is allowed to extend beyond a level of the bottom of the peripheral channel of the bucket.

2. The bucket according to claim 1 further comprising a filler piece arranged underneath the peripheral channel and connecting up to both the bottom of the peripheral channel and an area of the standing wall of the bucket that is adjacent to the area where the filler piece is attached to the bottom of the peripheral channel.

3. The bucket according to claim 2, wherein the filler piece has a narrow, sheet-like appearance.

4. The bucket according to claim 2, wherein the filler piece is beveled; and wherein a width of the filler piece increases in an upward direction.

5. The bucket according to claim 2, wherein a width of the filler piece corresponds to a width of the bottom of the peripheral channel at a position where the filler piece is connected to the bottom of the peripheral channel.

6. The bucket according to claim 2 further comprising a bottom;

wherein the inner standing wall of the peripheral channel has at least one opening constituting a passage between the peripheral channel and an internal space of the bucket as defined by the bottom and the standing wall of the bucket.

7. The bucket according to claim 6, wherein at least one of the openings in the inner standing wall of the peripheral channel is positioned in an area of the peripheral channel that is present above the filler piece.

8. The bucket according to claim 1 further comprising a bottom;

wherein the inner standing wall of the peripheral channel has at least one opening constituting a passage between the peripheral channel and an internal space of the bucket as defined by the bottom and the standing wall of the bucket.

9. A bucket for use as a bottom part of a packing device comprising:

a bottom;

a standing wall; and a peripheral channel having a bottom and an inner standing wall;

wherein the peripheral channel is open at a top side for receiving and retaining a bottom portion of a top part of the packing device;

wherein the peripheral channel projects outwardly with respect to the standing wall;

wherein a bottom portion of the inner standing wall of the peripheral channel extends at a distance to the standing wall of the bucket so that at the level of the peripheral channel a space is present between the bottom portion of the inner standing wall of the peripheral channel and the standing wall of the bucket, which space is accessible from the bottom side;

wherein a top portion of the inner standing wall of the peripheral channel is constituted by the standing wall of the bucket;

wherein the space present between the bottom portion of the inner standing wall of the peripheral channel and the standing wall of the bucket functions to receive and accommodate a top portion of the standing wall of a second bucket when the bucket is stacked as the first bucket on top of the second bucket so that the top portion of the standing wall of the second bucket is allowed to extend beyond a level of the bottom of the peripheral channel of the bucket; and wherein the inner standing wall of the peripheral channel has at least one opening constituting a passage between the peripheral channel and an internal space of the bucket as defined by the bottom and the standing wall of the bucket.

10. A plate and bucket combination comprising:

the bucket according to claim 1; and a plate configured to receive and retain a bottom portion of the bucket and comprising a channel that is open at a top side for enabling the plate to receive liquid from the outside of the bucket.

11. The plate and bucket combination according to claim 10, wherein the channel of the plate extends at a position that is inward and at a distance from an outer periphery of the plate.

12. The plate and bucket combination according to claim 10, wherein the bucket has a bottom portion with a rectangular outer periphery;

wherein an outer periphery of the plate is rectangular;

wherein the plate comprises standing elements having a top recess for receiving a corner portion of the bottom portion of the bucket; and wherein the standing elements of the plate are hollow at a bottom side.

13. A packing device comprising:

a bottom part constituted by the bucket according to claim 1; and a sleeve-shaped top part;

wherein the top part is received and retained in the peripheral channel of the bucket.

14. The packing device according to claim 13 further comprising a plate configured to receive and retain a bottom portion of the bucket and comprising a channel that is open at a top side for enabling the plate to receive liquid from the outside of the bucket;

wherein the plate is placed on top of the top part.

15. A stack of packing devices comprising at least two packing devices according to claim 13, wherein the bucket of any packing device in the stack above a packing device located at a bottom of the stack is positioned on top of the plate of an underlying packing device in the stack.

* * * * *